US006129057A

United States Patent [19]

Langer

[11] Patent Number: 6,129,057

[45] Date of Patent: Oct. 10, 2000

[54] ENGINE BLOCK CASING AND INSERT MEMBER DIECAST FROM PERMANENT MOLDS

[75] Inventor: David M. Langer, Warren, Mich.

[73] Assignee: DaimlerChrysler Corporation, Aurburn Hills, Mich.

[21] Appl. No.: 09/246,023

[22] Filed: Feb. 5, 1999

[51] Int. Cl.[7] ..... F02F 1/10

[52] U.S. Cl. ..... 123/41.72; 123/41.74; 29/888.01

[58] Field of Search ..... 123/41.72, 41.74, 123/193.2, 195 R; 164/47, 129; 29/888.01

[56] References Cited

U.S. PATENT DOCUMENTS 4,493,359 1/1985 Bostater et al. ..... 164/58.1

*Primary Examiner*—Noah P. Kamen
*Attorney, Agent, or Firm*—Kenneth H. Maclean

[57] ABSTRACT

An engine block includes a unitary engine block casing having a cylinder wall and an upper peripheral wall spaced from the cylinder wall to define an open channel therebetween. The channel has a bottom formed by a portion of the engine block casing and an open top formed between the cylinder wall and the peripheral wall. An independent insert member is disposed in the open top of the channel extending between the cylinder wall and the peripheral wall for providing structural support between the cylinder wall and the peripheral wall. The invention further includes a method for diecasting the engine block using permanent molds. The steps of the method include: providing a first permanent mold; diecasting a unitary engine block casing in the first permanent mold, the casing including a cylinder wall and an upper peripheral wall spaced from the cylinder wall to define an open channel therebetween, the channel including a bottom formed by a portion of the engine block casing and an open top formed between the cylinder wall and the peripheral wall; providing a second permanent mold; diecasting an independent insert member in the second permanent mold; and fixing the insert member in the open top of the channel for providing structural support between the cylinder wall and the peripheral wall.

9 Claims, 4 Drawing Sheets

ENGINE BLOCK CASING AND INSERT MEMBER DIECAST FROM PERMANENT MOLDS

FIELD OF THE INVENTION

The subject invention relates to an engine block casing and an insert member diecast from permanent molds and, more particularly, to an engine block casing having a water jacket diecast from a first permanent mold and an insert member diecast from a second permanent mold, the insert member thereafter disposed in the engine block casing to structurally support the casing while maintaining the water jacket.

BACKGROUND OF THE INVENTION

Most engine blocks include a cooling system. Conventional engine cooling systems include engine coolant to control the temperature of the block and other engine components. In cold temperatures, the cooling system heats the block. In hot temperatures, the cooling system cools the block. Typically, the engine block includes channels, commonly referred to as water jackets, for circulating the engine coolant about the block.

In the past, engine blocks having water jackets have been manufactured primarily in two types of designs. A first type of engine block has an open top. That is, the block is manufactured with water jackets located between the walls of each cylinder and the adjacent outer walls of the engine block. This type of engine block is commonly referred to as an open deck engine block. Open deck engine blocks have several shortcomings. Foremost, the top of such blocks lack rigidity and, therefore, sometimes warp either initially during the manufacture of the engine or later during the operation of the engine.

To overcome this shortcoming, a second type of engine block has a partially closed top or deck. This engine block has been manufactured as a single piece block. Unlike the first design, this second type of engine block includes support material diecast between a portion of the cylinder wall and the adjacent outer engine block walls. The support material improves the rigidity of the top of the engine block yet does not significantly restrict coolant flow between the engine block and the other engine components. However, this second type of engine block also has several shortcomings. Foremost, temporary sand molds are required to manufacture this type of engine block as a single piece. Frequently, residual sand from the casting process damages tools used to machine the block. Accordingly, it would be desirable to provide an engine block having water jackets manufactured from only permanent molds.

SUMMARY OF THE INVENTION

An engine block includes a unitary engine block casing having a cylinder wall and an upper peripheral wall spaced from the cylinder wall to define an open channel therebetween. The channel has a bottom formed by a portion of the engine block casing and an open top formed between the cylinder wall and the peripheral wall. An independent insert member is disposed in the open top of the channel extending between the cylinder wall and the peripheral wall for providing structural support between the cylinder wall and the peripheral all.

The invention further includes a method for diecasting the engine block using permanent molds. The steps of the method include: providing a first permanent mold; diecasting a unitary engine block casing in the first permanent mold, the casing including a cylinder wall and an upper peripheral wall spaced from the cylinder wall to define an open channel therebetween, the channel including a bottom formed by a portion of the engine block casing and an open top formed between the cylinder wall and the peripheral wall; providing a second permanent mold; diecasting an independent insert member in the second permanent mold; and fixing the insert member in the open top of the channel for providing structural support between the cylinder wall and the peripheral wall.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
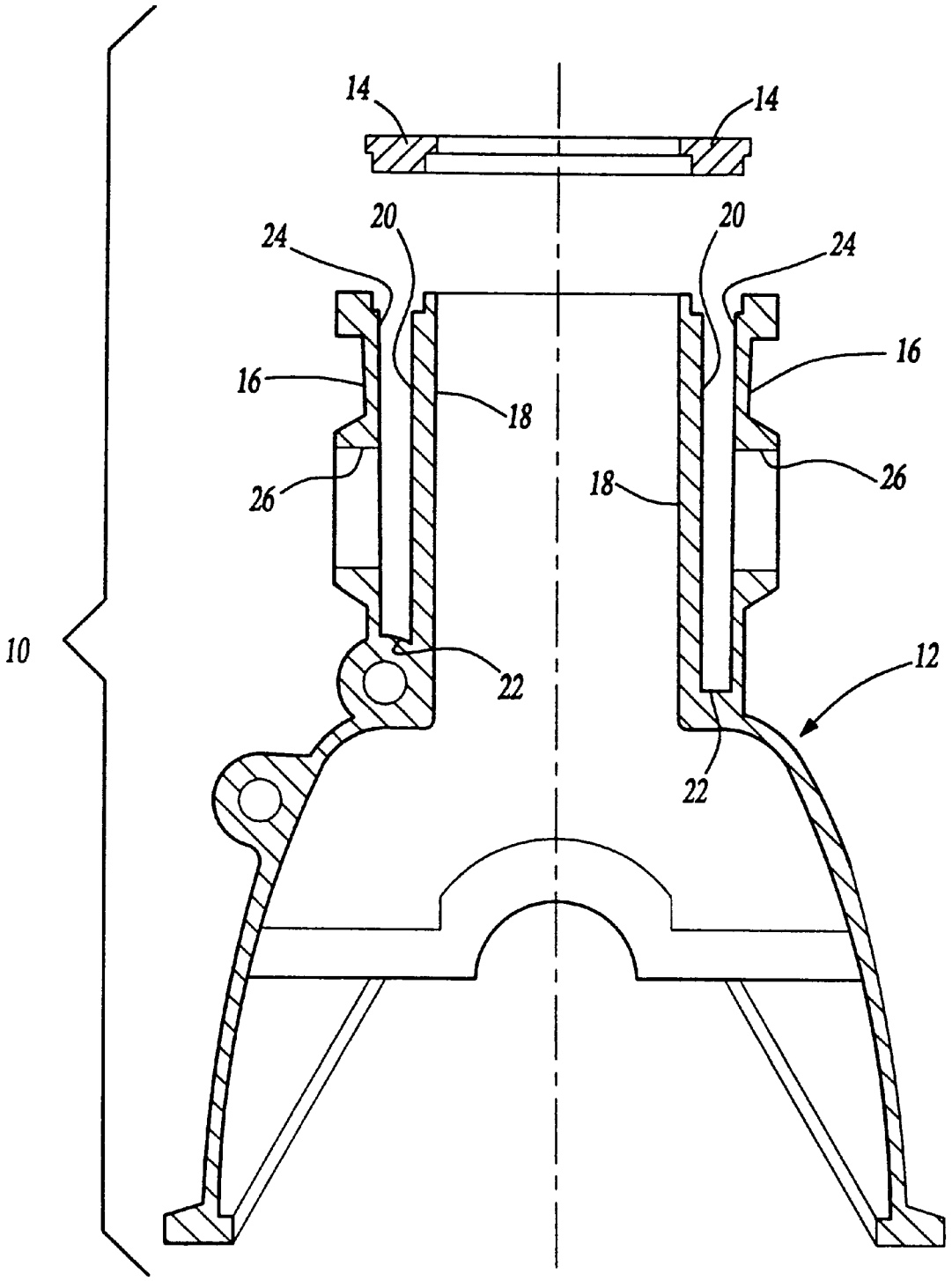
FIG. 1 is an exploded, cross-sectional front view of an engine block including an engine block casing and an independent insert member in accordance with the present invention.

Referring to the Figures, wherein like numerals indicate like or corresponding parts throughout the several views, an exploded, cross-sectional front view of an engine block 10 including an engine block casing 12 and an independent insert member 14 is shown in FIG. 1. The engine block casing 12 is a unitary piece including an at least one cylinder wall 18 and an upper peripheral wall 16 spaced from the cylinder wall 18 to define an open channel 20 therebetween.

The channel 20 includes a bottom 22 formed by a portion of the engine block casing 12 and an open top 24 formed between the cylinder wall 18 and the peripheral wall 16. The channel 20 defines a fluid channel, commonly referred to as a water jacket, for routing engine coolant through the channel 20 about the cylinder wall 18. Typically, the channel 20 includes an inlet (not shown) in the engine block casing 12 for receiving engine coolant from an engine cooling system (not shown). The engine coolant is typically circulated passed the cylinder wall 18 and into an engine head (not shown) attached on top of the engine block 10, as is commonly known to one skilled in the art.

A plurality of freeze plug holes 26, adapted to receive a freeze plug (not shown), are located in the peripheral wall 16. Freeze plugs are designed to break in response to block expansion. In this manner, freeze plugs prevent an engine block from cracking should the engine coolant freeze solid.

Figure 2:
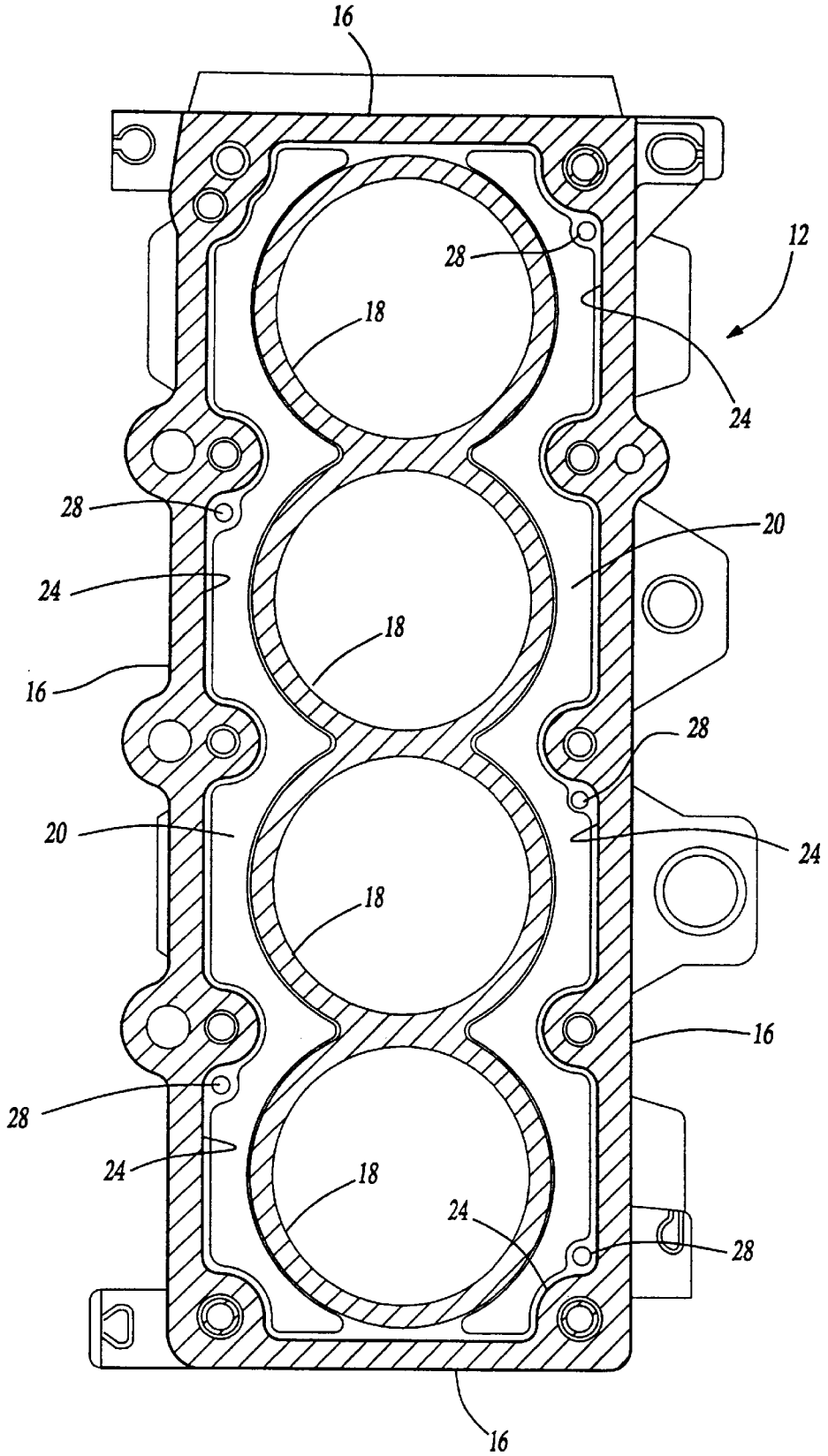
FIG. 2 is a top view of the engine block casing.

FIG. 2 is a top view of the engine block casing 12. In FIG. 2, the engine block casing 12 is illustrated to include four cylinder walls 18. Accordingly, the peripheral wall 16 of the engine block casing 12 is spaced from the four cylinder walls 18 to form the channel 20 therebetween.

The engine block casing 12 further includes at least one boss 28 located adjacent to the open top 24 of the channel 20. In FIG. 2, the engine block casing 12 is illustrated to include five bosses 28.

Figure 3:
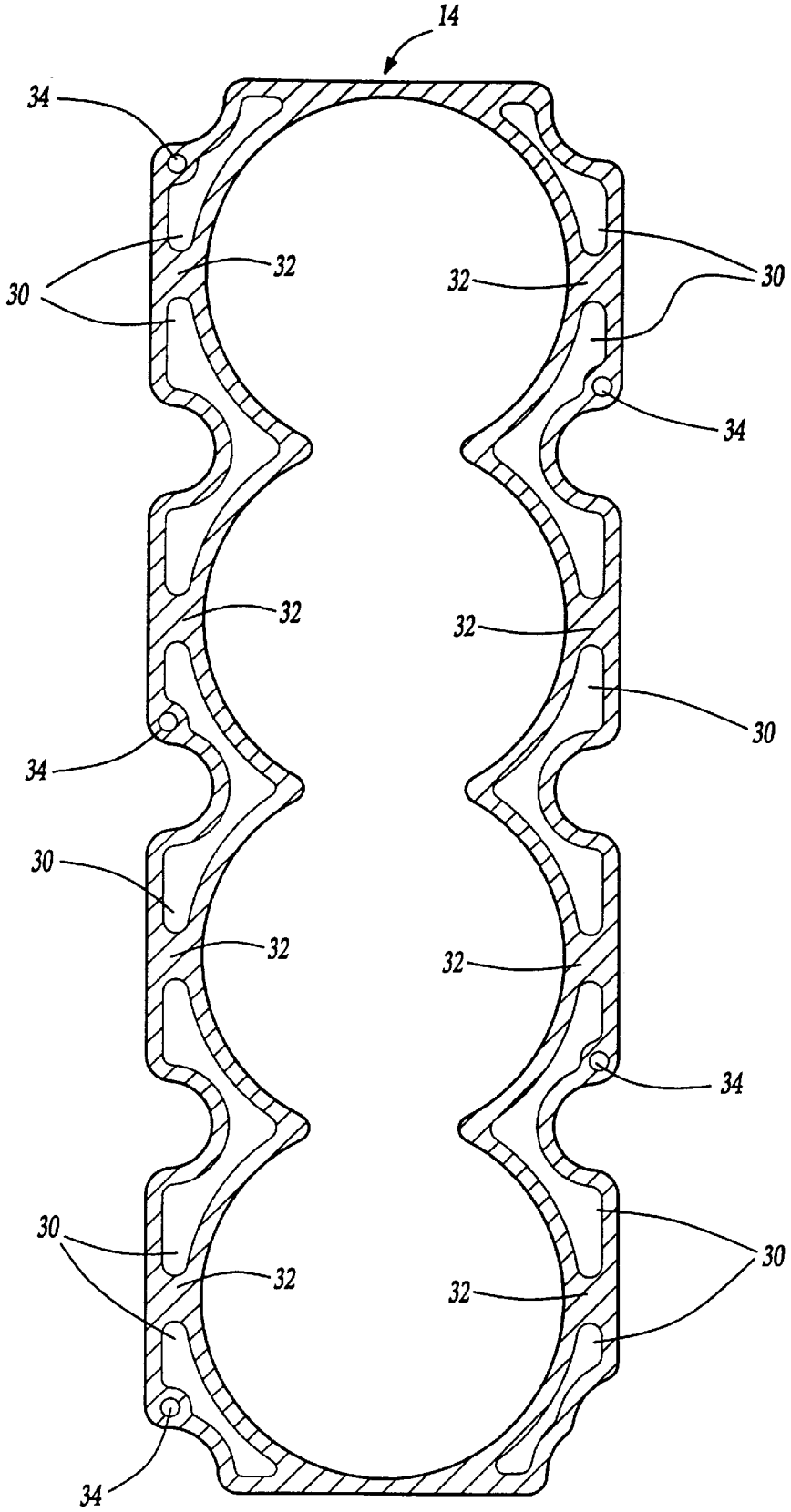
FIG. 3 is a top view of the independent insert member.

FIG. 3 is a top view of the independent insert member 14. The insert member 14 is adapted to be disposed in the open top 24 of the channel 20. The insert member 14 includes at least one passageway 30 and at least a solid portion 32. In FIG. 3, the insert member 14 is illustrated to include ten passageways 30 and eight solid portions 32.

When the insert member 14 is installed on the engine block casing 12, the passageways 30 are in fluid communication with the channel 20 and the solid portions 32 extend between the cylinder walls 18 and the peripheral wall 16 for providing structural support between the cylinder walls 18 and the peripheral wall 16 while maintaining the channel 20 therebetween. Typically, engine coolant from the channel 20 is circulated through the passageways 30 and into the engine head (not shown). The insert member 14 also includes at least one mounting hole 34 adapted to align with and receive each respective boss 28. In FIG. 3, the insert member 14 is illustrated to include five mounting holes 34 to join respectively with the five bosses 28 located on the engine block casing 12. Together, the engine block casing 12 and the insert member 14 form a partially closed deck engine block 10.

Unlike the prior art, the unique two-piece design of the engine block 10 is particularly adapted to be manufactured through permanent mold diecasting. Thus, a first permanent mold may be used to diecast the engine block casing 12 and a second permanent mold may be used to diecast the insert member 14.

Figure 4:
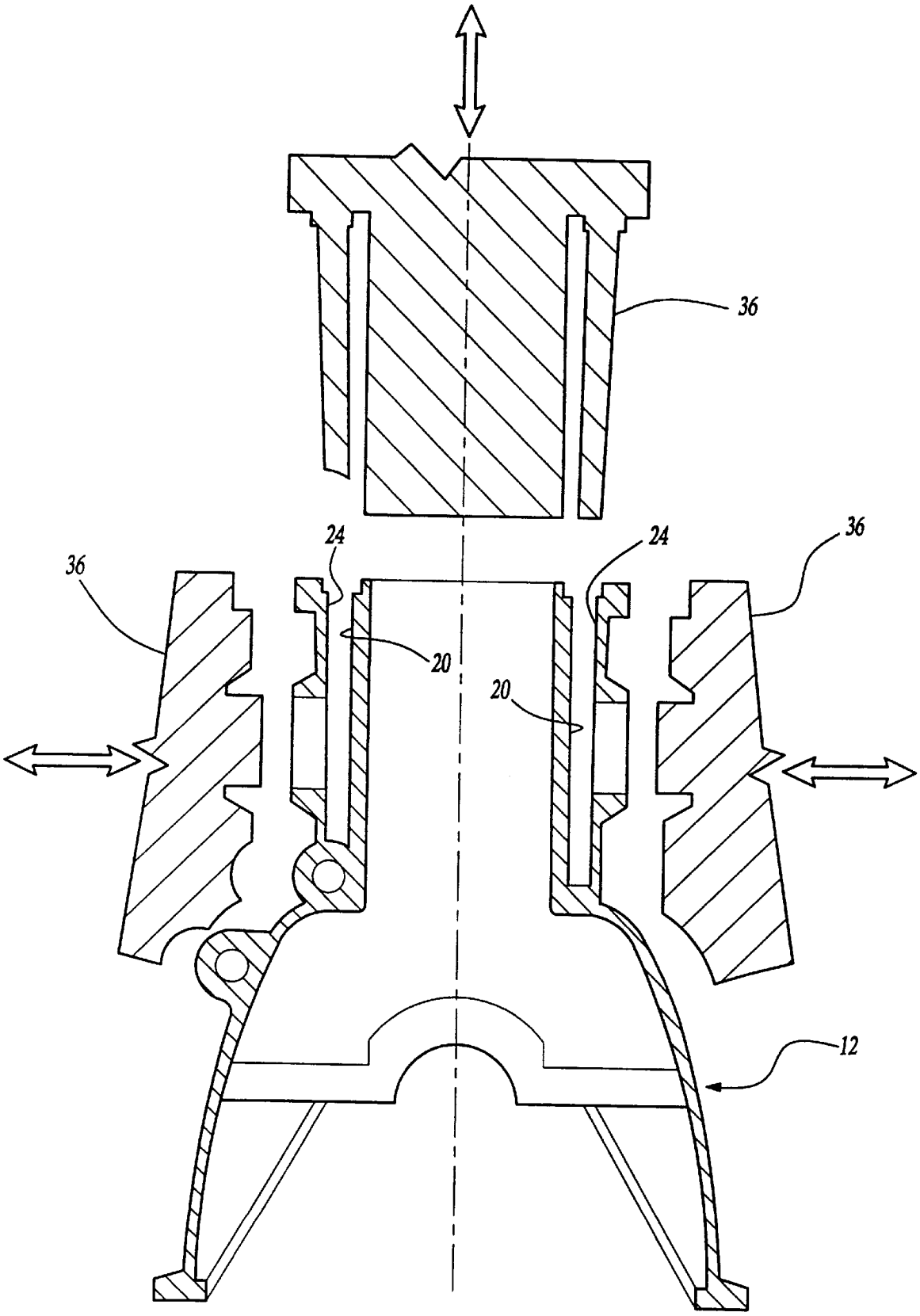
FIG. 4 is a cross-sectional front view of a permanent mold for diecasting the engine block casing.

FIG. 4 is a cross-sectional front view of a first permanent mold 36 for diecasting the engine block casing 12. The open top block design allows the channel or water jacket 20 to be diecast in the engine block casing 12 with the permanent mold 36. Thereafter, the insert member 14, having solid portions 32 to provide structural support for the cylinder walls 18 and the peripheral wall 16 and having passageways 30 to allow circulation of the engine coolant, is installed in the open top 24 of the channel 20 in the engine block casing 12.

Accordingly, the present invention also provides a method for diecasting the engine block 10 from permanent molds. As will be appreciated by one of ordinary skill in the art, although the method illustrates sequential steps, the particular order of processing is not important to achieving the objects of the present invention.

The steps of the method include: providing a first permanent mold; diecasting a unitary engine block casing in the first permanent mold, the casing including a cylinder wall and an upper peripheral wall spaced from the cylinder wall to define an open channel therebetween, the channel including a bottom formed by a portion of the engine block casing and an open top formed between the cylinder wall and the peripheral wall; providing a second permanent mold; diecasting an independent insert member in the second permanent mold; and fixing the insert member in the open top of the channel for providing structural support between the cylinder wall and the peripheral wall.

In a preferred embodiment of the method, the insert member is glued or secured with an adhesive to the engine block casing. This provides stability when the block is machined and thermally cycled during engine operation. To increase the stability of the engine block during the adhesive curing process, the insert member may be further secured to the engine block casing with rivets or self-tapping fasteners inserted at the boss/mounting hole locations.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. An engine block comprising:

a unitary engine block casing including a cylinder wall and an upper peripheral wall spaced from said cylinder wall to define an open channel therebetween;

said channel including a bottom formed by a portion of said engine block casing and an open top formed between said cylinder wall and said peripheral wall; and an independent insert member disposed in said open top of said channel extending between said cylinder wall and said peripheral wall for providing structural support between said cylinder wall and said peripheral wall.

2. An engine block as set forth in claim 1 wherein said insert member includes at least one passageway in fluid communication with said channel.

3. An engine block as set forth in claim 2 wherein said channel defines a fluid channel for routing engine coolant through said channel about said cylinder wall.

4. An engine block as set forth in claim 1 wherein said engine block casing includes at least one boss and said insert member includes at least one mounting hole adapted to align with and receive said boss.

5. A method for diecasting an engine block using permanent molds, the steps comprising:

providing a first permanent mold;

diecasting a unitary engine block casing in the first permanent mold, the casing including a cylinder wall and an upper peripheral wall spaced from the cylinder wall to define an open channel therebetween, the channel including a bottom formed by a portion of the engine block casing and an open top formed between the cylinder wall and the peripheral wall;

providing a second permanent mold;

diecasting an independent insert member in the second permanent mold; and fixing the insert member in the open top of the channel for providing structural support between the cylinder wall and the peripheral wall.

6. A method as set forth in claim 5 wherein the step of fixing the insert member in the open top of the channel includes securing the insert member in the open top of the channel with an adhesive.

7. A method as set forth in claim 5 wherein the step of fixing the insert member in the open top of the channel includes securing the insert member in the open top of the channel with a rivet.

8. A method as set forth in claim 5 wherein the step of fixing the insert member in the open top of the channel includes securing the insert member in the open top of the channel with a self-tapping fastener.

9. A method as set forth in claim 5 further including the step of forming at least one passageway in the insert member for providing fluid communication between the insert member and the channel.

* * * * *